US005323548A

United States Patent [19]

Vogel

[11] Patent Number: 5,323,548

[45] Date of Patent: Jun. 28, 1994

[54] SKI BOOT

[76] Inventor: Raimund W. Vogel, Lierstr. 25, D8 Munich 19, Fed. Rep. of Germany

[21] Appl. No.: 51,126

[22] Filed: Apr. 26, 1993

Related U.S. Application Data

[63] Continuation of Ser. No. 815,154, Dec. 31, 1991, abandoned.

[30] Foreign Application Priority Data

Feb. 12, 1991 [DE] Fed. Rep. of Germany ..... 4104243
Nov. 30, 1991 [DE] Fed. Rep. of Germany ..... 4139527

[51] Int. Cl.[5] ..... A43B 5/04
[52] U.S. Cl. ..... 36/121
[58] Field of Search ..... 36/117-121

[56] References Cited

U.S. PATENT DOCUMENTS

| | | | |
|---|---|---|---|
| 3,313,046 | 4/1967 | Werner et al. | 36/119 |
| 3,410,006 | 11/1968 | Vogel | 36/119 X |
| 3,552,044 | 1/1971 | Weile | 36/119 X |
| 3,619,914 | 11/1971 | Hanson et al. | 36/121 |
| 3,636,642 | 1/1972 | Walther | 36/120 |
| 3,686,778 | 8/1972 | Hornung | 36/120 |
| 3,793,747 | 2/1974 | Machizuki | 36/121 |
| 4,199,879 | 4/1980 | Wegeng | 36/121 |
| 4,404,758 | 9/1983 | Kopp | 36/121 |
| 4,420,895 | 12/1983 | Boumann et al. | 36/118 |
| 4,455,769 | 6/1984 | Fritisch | 36/121 |
| 4,473,235 | 9/1984 | Burt | 36/121 X |
| 4,611,414 | 9/1986 | Vogel | 36/119 X |
| 4,693,020 | 9/1987 | Salas et al. | 36/121 X |
| 4,761,899 | 8/1988 | Marxer | 36/121 |

FOREIGN PATENT DOCUMENTS

| | | | |
|---|---|---|---|
| 0840680 | 5/1970 | Canada | 36/121 |
| 2057094 | 5/1973 | Fed. Rep. of Germany | 36/121 |

*Primary Examiner*—Paul T. Sewell
*Assistant Examiner*—Ted Kavanaugh

[57] ABSTRACT

A ski boot made different functional parts comprises a hard shell for taking up the foot and a cuff for gripping the lower leg of a skier. The hard shell and the cuff are connected together by lever bands which reinforce the lateral sides of the cuff. The lever bands are hinged at the hard shell at pivot points arranged at both sides of the hard shell. Furthermore the lever bands are rigidly connected to two free ends of an U-shaped part pivoting together with the lever bands. The U-shaped part surrounds the rear of the ski boot. At least one piston is rigidly connected with the rear part of the U-shaped part. Each piston slides in at least one cylindrical receptacle and compresses at least one elastic compression element in the cylindrical receptacle. Such receptacle is connected to the hard shell by at least one intermediate means so that the receptacle is able to be flexed together with the cuff. The elastic compression element is designed to limit forward pivoting movement of the cuff in relation to the hard shell to 40°/45°.

12 Claims, 1 Drawing Sheet

SKI BOOT

REFERENCE TO COPENDING APPLICATION

Figure 1A:
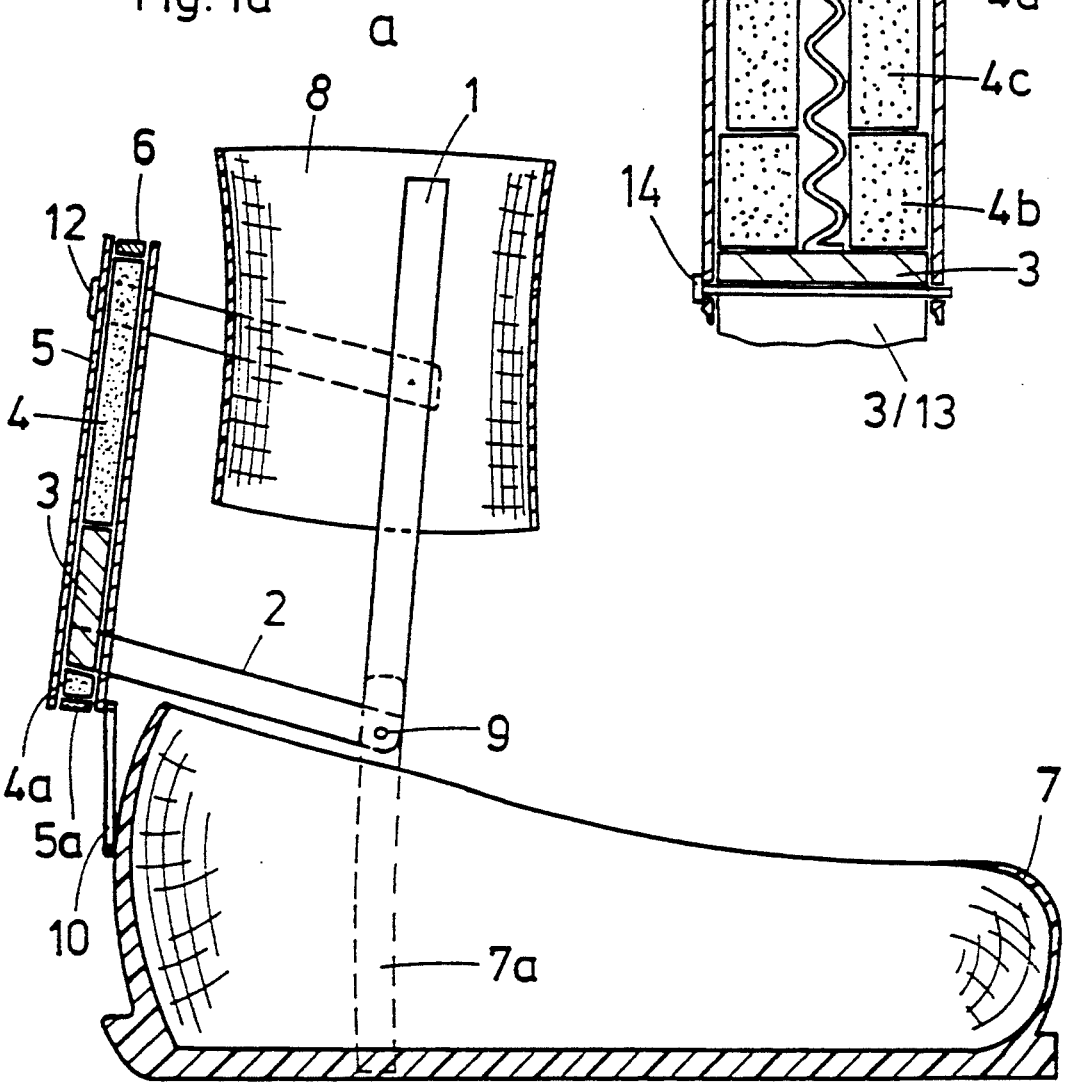

The present application is a continuation application of my application of Dec. 31, 1991 Ser. No. 07/815/154 now abandoned.

BACKGROUND OF THE INVENTION

The present invention relates to a ski boot made of a hard shell for taking up a foot of a skier and a hinged cuff for gripping a lower leg of said skier. Said cuff pivots forwardly and backwardly in relation to said hard shell. Said forward pivoting is damped and limited to 40° by at least one elastic compression element. The described ski boot satisfies the demands of orthopedists in relation to dynamic skiing in preventing knee injuries.

THE PURPOSE OF THE INVENTION

The purpose of the invention is in fact to create a ski boot having the desired properties, namely: to maintain the functional properties of the ski boot described in the U.S. Pat. No. 4,611,414 whilst improving the means of modifying its characteristics as regards the following:

a) ease in modifying a progressive elastic resistance to forward and backward pivoting movement of said cuff gripping said lower leg of said skier and
b) its range of pivoting movement and
c) alternatively providing limited backward pivoting movement of said cuff before a knee injury occurs
d) preventing knee injuries in general and
e) simplicity of manufacture

OPINION OF EXPERTS

The following articles demonstrate that knee injuries are caused by ski boots having a cuff which fails to pivot approximately 0° thru 40°/45° against an increasing and progressive elastic resistance, the exception being the ski boots treated in the following.

Articles a) Prof. Dr. A. Vogel: Ergebnisse goniometrischer Messungen beim Skifahren and b) Dr. P. Schaff, Dr. W. Hauser: Skischuh versus Kniegelenk-ein sportmedizinisches, orthopädisches und biomechanisches Problem.

DISCUSSION OF THE INVENTION IN LIGHT OF THE PRIOR ART

Neither the purpose of the invention nor essential functional parts of it are anticipated by the prior art. The present invention takes into account the invention of my previous U.S. Pat. No. 4,611,414 and provides an improvement of the structure thereof.

The ski boot of U.S. Pat. No. 4,611,414 pivots as required by orthopedists and experts whilst also providing extremely high lateral stiffness. However, there are limits to modifying said elastic resistance towards the cuff due to the lengths of said lever bands from their pivot points downwards to the sole part of said boot so that both said resistance and also the pivoting of said cuff is limited. This limitation is overcome by the later described function and its functional parts of the invention, especially its U-shaped part.

STATEMENT OF THE INVENTION

The invention provides a ski boot comprising a lower part and a cuff, said lower part being a hard shell for taking up the foot of a skier, said cuff extending above said hard shell for gripping the lower leg of said skier, said cuff being pivotable forwardly and backwardly in relation to said hard shell, said hard shell and said cuff being connected laterally by lever bands which reinforce the lateral sides of said cuff and are pivotable about pivot points arranged on both lateral sides of said hard shell, said lever bands being rigidly connected to free ends of an U-shaped part which is pivotable together with said lever bands said u-shaped part surrounding the rear of said boot at least one piston being rigidly connected with said U-shaped part to cooperate in a force-transmitting manner with at least one elastic compression element which is arranged in at least one cylindrical receptacle, which extends above said shell and is connected to said hard shell by an intermediate means allowing said receptacle to pivot together with said cuff, said compression element limiting the forward pivoting movement to 40 degrees and backward pivoting movement to 5 degrees of said cuff in relation to said hard shell by progressively increasing resistance of said compression element.

In contradiction to U.S. Pat. No. 4,611,414 the elastic compression element is no longer arranged in the region of the sole of said boot but is arranged according to the invention to the rear of said cuff. Forward/backward bending of the lower leg in the cuff is transmitted to at least one said elastic compression element by lever bands connected to said cuff and pivotably connected at hinge points to said hard shell, a U-shaped part being connected at its two ends to said lever bands. At least one cylindrical receptacle contains at least one elastic compression element, whereby said receptacle is connected by intermediate means to said hard shell. Said piston is slidably arranged in said receptacle and connected to said u-shaped part in its backward region. The elastic compression element can be made of any suitable material capable of withstanding compression or tensile stress, but is preferably made of an elastic cellular material which may be supplemented by a metal spring, if required. Especially suitable for the cellular material is Vulkollan (reg. trademark). This is only suitable for compression stresses.

The simple force-transmitting structural parts described, such as said lever bands and said U-shaped part are preferably made of spring steel or of a plastic reinforced, where necessary, to have high strength and low thermal expansion in length and a long life.

Arranging said elastic compression element at the rear region of said ski boot offers the additional, following advantages:

a) Size and shape of said U-shaped part are also able to contribute to the lateral stiffness of the lever bands when pivoting forward/backward and thus to said stiffness of the ski boot in its rear region,
b) easy replacement of said elastic compression element and thus facilitated modification of the pivoting range due to said elastic element of differing quality and dimensions due to latter being easily accessible outside of the ski boot,
c) simple, low-cost production, particularly of said force-transmitting parts and simple replacement of all parts forming the ski boot when they are worn or damaged.

Said u-shaped part has two ends which are connectable to said lever bands at various points of its length so that the radius of said u-shaped part and thus the compressive forces acting on the elastic compression element are adjustable. Alternatively, said U-shaped part can be connected to said lever bands so as to allow angle adjustment.

One possibility of modifying said resistance of said elastic compression element of cellular elastic material is to close off said receptacle at its upper end by a height-adjustable cover to effect pretensioning of said compression element.

Backward pivoting of said lever bands is limited in its progressive elasticity by at least one further elastic compression element arranged between said piston and a lower cover closing off said receptacle downwards in the direction of said sole. By modifying said elastic compression element according to the anatomically resulting backward bending of said lower leg by approx. 5° is automatically achieved with progressively elastic limiting of said pivoting movement.

Should a skier fall backwards a lower cover can also serve to prevent knee pit sprains or injuries. Said cover is connected to said receptacle by a flat spring so that it releases from said receptacle when a specified compression of said compression element is reached, thus releasing said cuff pivoting with said lower leg backward.

All force-transmitting functional parts together offer practically the possibilities of modifying said resistance to and the range of pivoting of said cuff when a) replaceable cellular elastic compression elements of differing outer dimensions and bulk density are provided one above the other in at least one receptacle;
b) the bore of said receptacle is graduated;
c) in addition to said elastic compression element at least one metal spring is provided or
d) said elastic compression element is pretensioned in said receptacle.

By suitable selection of said factors a)–d) practically any continuously adjustable resistance curve useful to the skier e.g. a hysteresis curve can be produced. Preferably at least the main part of said elastic compression element in said receptacle is made from Vulkollan blocks cut to size, these being much cheaper than when molded.

Reproduction of said values of said curve (hysteresis), once established, is possible both in the test lab and on the ski slope since this system is self-contained.

Said hard shell and said receptacle is connected by at least one longitudinal inextensible intermediate means which is capable of flexing.

LIST OF DIFFERENT VIEWS OF THE FIGURES

FIG. 1*a* shows a schematic arrangement of said functional parts

Figure 1B:
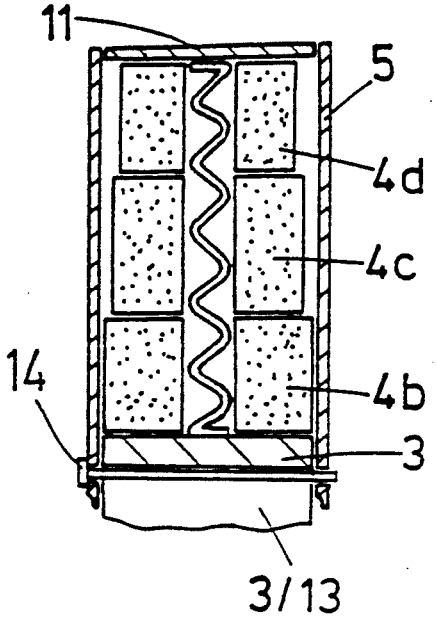
Figure 2A:
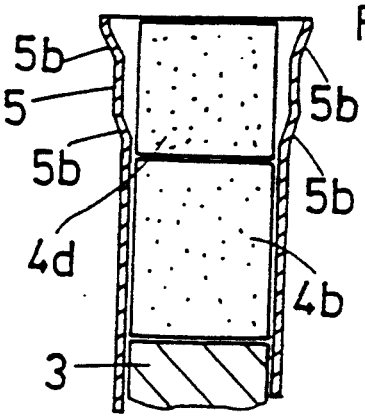
Figure 2B:
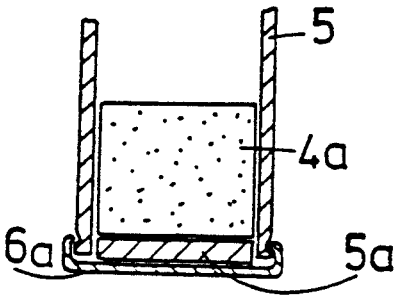

FIG. 1*b* shows said cylindrical receptacle for said elastic compression element FIG. 2*a* shows another cylindrical receptacle for said elastic compression element FIG. 2*b* shows the lower end of said cylindrical receptacle

DETAILED ACCOUNT OF WORKING EXAMPLES OF THE INVENTION

FIG. 1*a* shows a schematic arrangement of said hard shell 7 with a hinged cuff 8 and an elastic compression element 4 in said receptacle 5. Said cuff 8 is pivotally connected at pivot points 9 by lever bands 1 to said shell 7 for lateral stiffness and freedom of pivoting movement forwards and backwards. To make said shell 7 lighter without sacrificing lateral stiffness it can be made of reinforced plastic or e.g. by an in plastic embedded flat steel band 7*a* of spring steel in a dimension 1×30 mm in the ankle regions of said hard shell 7. This reinforcement is shaped as an U on both sides of said shell 7 and its sole. On forward bending of said lower leg said cuff 8 is elastically damped owing to its cooperation with one or more elastic compression elements 4, the latter transmitting said pivoting movement of said lever bands 1 as a compressive loading effect via said U-shaped part 2 which is laterally connected at its two ends to said lever bands 1. There is a forward pivoting of said lever bands 1 at said pivot points 9 of said U-shaped part 2, the latter being connected to said piston 3 arranged slidingly in said receptacle 5. Said receptacle 5 is closed off by a vertical adjustable cover 6 at its upper end and is connected downward to said shell 7 by an intermediate means 10 which provides forward/backward pivoting of said receptacle 5. The pressure on the pivotable cuff 8 can be alternatively modified by changing the length of said intermediate means 10. Said cuff 8 and said receptacle 5 keep the same distance apart during pivoting of said cuff 8. The receptacle 5 is rectangular.

Several receptacles 5 may be provided which are rectangular or round in cross-section if said piston 3 is modified accordingly. Said cuff 8 may be of rigid and possibly reinforced plastic or of high-strength lightweight fabric comfortably. Said cuff 8 and said hard shell 7 may be connected by a fabric-like material which is permeable to air but impermeable to water. If such fabric is not used pants can fulfill the same function. 12 is an equidistant spacing means which can alternatively connect said receptacle 5 to said lever bands 1.

Below said piston 3 a further elastic compression element 4*a* is arranged in said receptacle 5 closed off at its lower end by a lower cover 5*a*. This allows for elastic backward pivoting movement of said cuff 8 through approx. 5°.

FIG. 1*b* is a section through said receptacle 5 in which three different elastic compression elements 4*b*, 4*c*, 4*d* of cellular elastic material are arranged, through which a helical spring 11 of metal extends coaxially. The bulk density of 4*b* is 400 kp/m$^3$, that of 4*c* is 550 kp/m$^3$ and that of 4*d* 700 kp/m$^3$. Each differs in its outer dimensions. When subject to pressure they allow their resistance to be modified, depending on their distance away from the bore faces of said receptacle 5. The pressure force acting on said elastic compression elements 4 is transmitted by said pistons 3. By replacing said elastic compression elements 4 by others having different bulk densities and different outer dimensions modifying said resistance to said pivoting movement is possible at any time.

A pin-like means 14 for limiting the forward and backward pivoting of said cuff 8 is provided replaceably in said receptacle 5. Said piston 3 has a notch 13 to receive said pin 14. The length of said notch 13 for said pin 14 in the direction of its upward/downward movement determines the travel of said pivoting cuff 8. This notch 13 may be lined with a flexible material.

FIG. 2*a* shows how the bore face of said receptacle 5 can be modified in steps 5*b* with respect to said elastic compression elements 4*b*, 4*d*. The effect is the same as shown in FIG. 1*b*.

FIG. 2*b* shows the lower end of said receptacle 5 with said lower cover 5*a* closing it off, said cover being fixed in place by a flat metal spring 6*a* which is connected to said receptacle 5. If the skier falls backwards said elastic compression element 4a is pressed against said lower cover 5a which together with said flat spring 6 is designed so that said spring 6a opens allowing said receptacle 5 and said cuff 8 to pivot backwardly.

Pretensioning said elastic compression elements 4, 4a, 4b, 4c by pressure can be achieved by compressively fixing said elastic compression elements in said receptacle 5.

I claim:

1. A ski boot comprising a lower part and a cuff, said lower part being a hard shell for taking up the foot of a skier, said cuff extending above said hard shell for gripping the lower leg of said skier, said cuff being pivotable forwardly and backwardly in relation to said hard shell, said hard shell and said cuff being connected laterally by lever bands which reinforce the lateral sides of said cuff and are pivotable about pivot points arranged on both lateral sides of said hard shell, said lever bands being rigidly connected to free ends of an U-shaped part which is pivotable together with said lever bands said U-shaped part surrounding the rear of said boot at least one piston being rigidly connected with said U-shaped part to cooperate in a force-transmitting manner with at least one elastic compression element which is arranged in at least one cylindrical receptacle, which extends above said shell and is connected to said hard shell by an intermediate means allowing said receptacle to pivot together with said cuff, said compression element limiting the forward pivoting movement to 40 degrees and backward pivoting movement to 5 degrees of said cuff in relation to said hard shell by progressively increasing resistance of said compression element.

2. A ski boot according to claim 1 wherein said U-shaped part is rigidly connectable to said lever bands at various points of its length.

3. A ski boot according to claim 1 wherein said U-shaped part is connected angle-adjustable to said lever bands in a manner allowing adjustment of the angle therebetween.

4. A ski boot according to claim 1 wherein said elastic compression element is pretensable by an upper cover of said cylindrical receptacle, the distance of said cover from the piston being adjustable to affect pretensioning of said compression element.

5. A ski boot according to claim 1 comprising:

a retaining cover secured at a lower end of said cylindrical receptacle, a further lower elastic compression element located in a part of said cylindrical receptacle extending between a lower surface of said piston and said lower end of said cylindrical receptacle, said elastic compression element being adapted to undergo compression on downward movement of said piston in said cylindrical receptacle toward said retaining cover.

6. A ski boot according to claim 5 comprising a spring steel elastic holding element at least partly encompassing said retaining cover and force-releasably fixed to said lower end of said cylindrical receptacle.

7. A ski boot according to claim 5 wherein said cover is made by flat spring steel.

8. A ski boot according to claim 1 wherein said elastic compression element comprises at least one elastic compression element made of cellular elastic material.

9. A ski boot according to claim 1 wherein said elastic compression element comprises further at least one metal spring.

10. A ski boot according to claim 1 wherein a plurality of replacable cellular elastic compression elements having different bulk densities are arranged in said cylindrical receptacle.

11. A ski boot according to claim 1 wherein in said receptacle the stroke of said piston is limitable by at least one pin-like means insertible in to said cylindrical receptacle.

12. A ski boot according to claim 1 wherein the bore of said cylindrical receptacle features graduations of different internal dimension.

* * * * *